US009872551B2

(12) United States Patent
Swaile et al.

(10) Patent No.: US 9,872,551 B2
(45) Date of Patent: Jan. 23, 2018

(54) PACKAGED ANTIPERSPIRANT COMPOSITIONS

(71) Applicant: The Procter & Gamble Company, Cincinnati, OH (US)

(72) Inventors: David Frederick Swaile, Cincinnati, OH (US); Jody Lynn Hoying, Maineville, OH (US); Lola Roming Kelly Smalls, Maineville, OH (US); Joyce Marie Benjamin, Mason, OH (US); Roland Stark, Warfield (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/601,882

(22) Filed: Jan. 21, 2015

(65) Prior Publication Data

US 2015/0201735 A1 Jul. 23, 2015

Related U.S. Application Data

(60) Provisional application No. 61/929,883, filed on Jan. 21, 2014.

(51) Int. Cl.

| | |
|---|---|
| ***A45D 40/26*** | (2006.01) |
| ***A45D 40/06*** | (2006.01) |
| ***A45D 40/04*** | (2006.01) |

(52) U.S. Cl.

CPC ..... *A45D 40/261* (2013.01); *A45D 40/04* (2013.01); *A45D 40/065* (2013.01); *A45D 40/26* (2013.01);

(Continued)

(58) Field of Classification Search

CPC ..... A45D 40/02; A45D 40/04; A45D 40/26; A45D 2200/15; A45D 2200/155

(Continued)

(56) References Cited

U.S. PATENT DOCUMENTS

| | | | |
|---|---|---|---|
| 2,048,229 | A | 7/1936 | Snow |
| 3,887,692 | A | 6/1975 | Gilman |

(Continued)

FOREIGN PATENT DOCUMENTS

| | | | |
|---|---|---|---|
| BE | 825146 | A | 4/1975 |
| FR | 2946508 | B1 | 4/2012 |
| GB | 1 347 950 | A | 2/1974 |

OTHER PUBLICATIONS

PCT International Search Repaort, dated May 7,2015 (9 pages).

*Primary Examiner* — Jennifer C Chiang
*Assistant Examiner* — Bradley Oliver
(74) *Attorney, Agent, or Firm* — Kathleen Y. Carter; Carrie M. Schwartz

(57) ABSTRACT

A packaged antiperspirant product is provided. The packaged antiperspirant product includes an anhydrous antiperspirant composition having an antiperspirant active and a package having a container body with an interior chamber storing the anhydrous antiperspirant composition. A dome closes one end of the container body and has a plurality of apertures extending through the thickness of the dome. A movable elevator is disposed within the container body. The anhydrous antiperspirant composition is expellable through the plurality of apertures when the elevator is advanced toward the dome. The dome is formed at least in part from a thermally conductive material and wherein one of the dome or the thermally conductive material have a thermal conductivity greater than about 5 W/m·K.

10 Claims, 8 Drawing Sheets

(52) U.S. Cl.
CPC .. *A45D 2200/055* (2013.01); *A45D 2200/155* (2013.01)

(58) Field of Classification Search
USPC ..... 401/265
See application file for complete search history.

(56) References Cited

U.S. PATENT DOCUMENTS 3,904,741 A 9/1975 Jones et al.
4,120,948 A 10/1978 Shelton
4,331,609 A 5/1982 Orr
4,356,938 A 11/1982 Kayser
4,359,456 A 11/1982 Gosling et al.
4,840,789 A 6/1989 Orr et al.
4,853,214 A 8/1989 Orr
5,000,356 A 3/1991 Johnson et al.
5,007,755 A * 4/1991 Thompson ..... A45D 40/04 401/171
5,019,375 A 5/1991 Tanner et al.
5,102,656 A 4/1992 Kasat
5,178,881 A 1/1993 Mackles et al.
5,294,447 A 3/1994 Mackles et al.
5,429,628 A 7/1995 Trinh et al.
5,711,941 A 1/1998 Behan et al.
5,843,414 A 12/1998 Hilvert et al.
5,861,144 A 1/1999 Peterson et al.
6,143,284 A 11/2000 Bush et al.
6,426,062 B1 7/2002 Chopra et al.
6,572,300 B2 6/2003 Altonen et al.
6,616,921 B2 9/2003 Rielly et al.
6,849,251 B2 2/2005 Banowski et al.
7,655,719 B2 2/2010 Miller
8,147,808 B2 4/2012 Scavone et al.
8,221,885 B2 7/2012 Miller
8,235,615 B2 8/2012 Yarlagadda
8,388,249 B2 3/2013 Groh et al.
8,518,425 B2 8/2013 Chan et al.
2003/0029889 A1 2/2003 Thompson et al.
2003/0040563 A1 2/2003 Sagal et al.
2003/0185777 A1* 10/2003 Banowski ..... A61K 8/26 424/66
2007/0186951 A1 8/2007 Gueret
2010/0104612 A1 4/2010 Cropper et al.
2010/0104613 A1 4/2010 Chan et al.
2010/0196079 A1* 8/2010 Bolander ..... A45D 40/04 401/68
2011/0268802 A1 11/2011 Dihora et al.
2011/0269657 A1 11/2011 Dihora et al.
2011/0269658 A1 11/2011 Dihora et al.
2012/0156152 A1 6/2012 Bianchi
2013/0189208 A1 7/2013 Bianchi et al.
2014/0023425 A1* 1/2014 Bonnin ..... A45D 40/26 401/265
2014/0154197 A1 6/2014 Swaile et al.

* cited by examiner

PACKAGED ANTIPERSPIRANT COMPOSITIONS

FIELD OF THE INVENTION

The present application is directed to packaged antiperspirant compositions and methods relating thereto.

BACKGROUND OF THE INVENTION

There are many types of topical antiperspirant products that are commercially available or otherwise known. Most of these products are formulated as sprays, roll-on liquids, creams like soft solids, or solid sticks, and comprise an astringent material, e.g. zirconium or aluminum salts, incorporated into a suitable topical carrier. These products are designed to provide effective perspiration and odor control while also being cosmetically acceptable during and after application onto the axillary area or other areas of the skin. Some examples of antiperspirant compositions are described in U.S. Pat. Nos. 4,840,789; 4,853,214; 5,019,375; 5,102,656; 5,178,881; 5,294,447; 5,843,414; 6,616,921; 6,426,062; 6,849,251 and 2003/0185777.

Within this product group, soft solid antiperspirant compositions are a popular and an effective alternative to antiperspirant sprays and solid sticks. Soft solid antiperspirant compositions are typically dispensed from a package having an immobile dispensing/applicator surface (versus a roller ball that is used for roll-on type antiperspirant compositions) that shears the composition onto the skin during use. Often, these dispensing/applicator surfaces are perforated, wherein the antiperspirant composition is pushed or extruded through the apertures by axial movement of an elevator within the package.

While perspiration and odor control provided by these products can be excellent, many of these antiperspirant compositions, however, may be cosmetically unacceptable to a various users because application may be messy, difficult to spread and wash off, and the applied areas often feel wet or sticky, as opposed to light and dry, for several minutes after application. While there have been some attempts to improve the performance of the package applicator surface (see, e.g., U.S. Pat. No. 6,572,300), there is a continuing need for antiperspirant composition packages that improve consumer delight at the time of application. Still further, there is a need for improved antiperspirant composition packages that provide a cool and/or refreshing feel at the time of application.

SUMMARY OF THE INVENTION

In accordance with one aspect of the invention, a packaged antiperspirant product is provided. The packaged antiperspirant product includes an anhydrous antiperspirant composition having an antiperspirant active and a package having a container body with an interior chamber storing the anhydrous antiperspirant composition. A dome closes one end of the container body and has a plurality of apertures extending through the thickness of the dome. A movable elevator is disposed within the container body. The anhydrous antiperspirant composition is expellable through the plurality of apertures when the elevator is advanced toward the dome. The dome is formed at least in part from a thermally conductive material and wherein one of the dome or the thermally conductive material have a thermal conductivity greater than about 5 W/m·K.

DETAILED DESCRIPTION OF THE INVENTION

Figure 1:
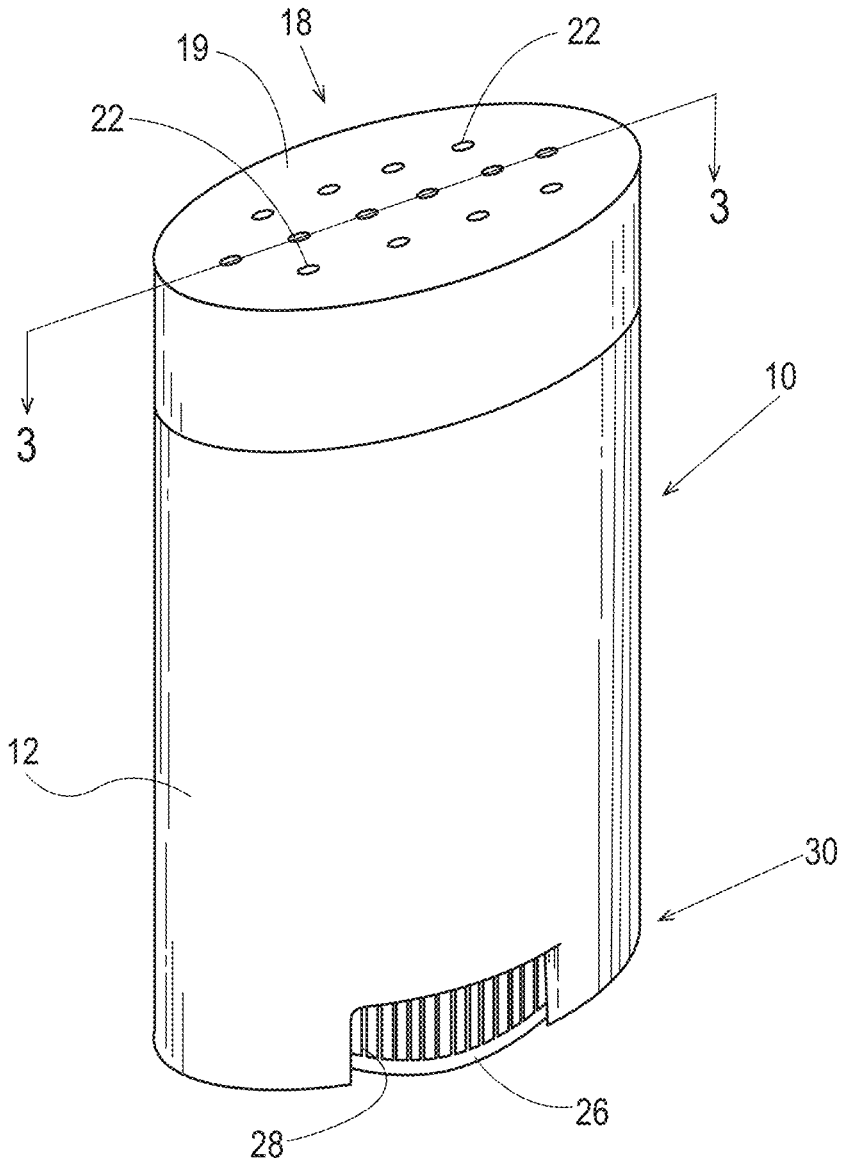
FIG. 1 is perspective view of a package suitable for use with antiperspirant compositions described herein.

Reference within the specification to "embodiment(s)" or the like means that a particular material, feature, structure and/or characteristic described in connection with the embodiment is included in at least one embodiment, optionally a number of embodiments, but it does not mean that all embodiments incorporate the material, feature, structure, and/or characteristic described. Furthermore, materials, features, structures and/or characteristics may be combined in any suitable manner across different embodiments, and materials, features, structures and/or characteristics may be omitted or substituted from what is described. Thus, embodiments and aspects described herein may comprise or be combinable with elements or components of other embodiments and/or aspects despite not being expressly exemplified in combination, unless otherwise stated or an incompatibility is stated.

In all embodiments, all percentages are by weight of the antiperspirant composition (or formulation), unless specifically stated otherwise. All ratios are weight ratios, unless specifically stated otherwise. All ranges are inclusive and combinable. The number of significant digits conveys neither a limitation on the indicated amounts nor on the accuracy of the measurements. All numerical amounts are understood to be modified by the word "about" unless otherwise specifically indicated. Unless otherwise indicated, all measurements are understood to be made at approximately 25° C. and at ambient conditions, where "ambient conditions" means conditions under about 1 atmosphere of pressure and at about 50% relative humidity. The term "room temperature" refers to 25° C. The term "molecular weight" or "M. Wt." as used herein refers to the number average molecular weight unless otherwise stated.

"Anhydrous" refers to compositions and/or components which are substantially free of or completely free of, water added as a separate component. The composition may, however, still contain water that comes in with raw materials (e.g., antiperspirant active, hydrophilic starches, etc.).

"Emollient" means a material that creates a lubricious feel or softening effect on skin. Emollients may be liquids or semi-solids at room temperature, such as gel.

"Gel antiperspirant composition" means an antiperspirant composition in the form of emulsion. In some instances, the gel antiperspirant composition may have an aqueous phase comprising more than 10%, 20%, 30%, 40%, or 50% water by weight of the antiperspirant composition.

"Liquid" means a material that is in a liquid or flowable state at room temperature as a raw material. "Non-polar" means materials having a Hildebrand solubility parameter of less than 16 $MPa^{1/2}$.

"Polar" means materials having a Hildebrand solubility parameter of more than 16 $MPa^{1/2}$.

"Solids" means particulate raw materials that never dissolve in the antiperspirant composition during processing and those materials that start as a solid at room temperature then dissolve or melt at high temperature and return to a solid state when the composition is cooled back to room temperature. "Substantially free of" means 5%, 3%, 1%, 0.5% or less or about 0.1% or less of a stated ingredient. "Free of" refers to no detectable amount of the stated ingredient or thing.

"Syneresis" means the separation or weeping of oil/liquid from an antiperspirant composition. This may occur, for example, when the antiperspirant composition is extruded thru an apertured dome of a package or during shipment from agitation.

"Thermal Conductivity", k, means the time rate of steady state heat flow through a unit area of a material induced by a unit temperature gradient, typically measured in W/m·K. Thermal conductivity may be measured according to ASTM E1461 or other methods, as known in the art.

"Viscosity" means dynamic viscosity (measured in centipoise, cPs, or Pascal-second, Pa·s) of a material or composition at approximately 25° C. and ambient conditions.

"Volatile" means a material that has a boiling point less than 250° C. at atmospheric pressure. "Non-volatile" means a material that has a boiling point greater than 250° C. at atmospheric pressure.

"Water insoluble hydrophilic oil" refers to an oil that is a liquid at room temperature, has a Hildebrand solubility parameter of greater than 16 $MPa^{1/2}$ and a water solubility of less than 1% wt in water at 20° C. Solubility parameters for the water insoluble hydrophilic oils and means for determining such parameters are well known in the chemical arts. A description of solubility parameters and means for determining them are described, for example, by C. D. Vaughan, "Solubility Effects in Product, Package, Penetration and Preservation" 103 Cosmetics and Toiletries 47-69, Oct. 1988; and C. D. Vaughan, "Using Solubility Parameters in Cosmetics Formulation", 36 J. Soc. Cosmetic Chemists 319-333, Sep./Oct., 1988, which descriptions are incorporated herein by reference.

"Wax" refers to materials of any molecular weight that are a solid at room temperature, melt at a temperature between about 40° C. and 125° C. and return to a solid at room temperature.

Figure 2:
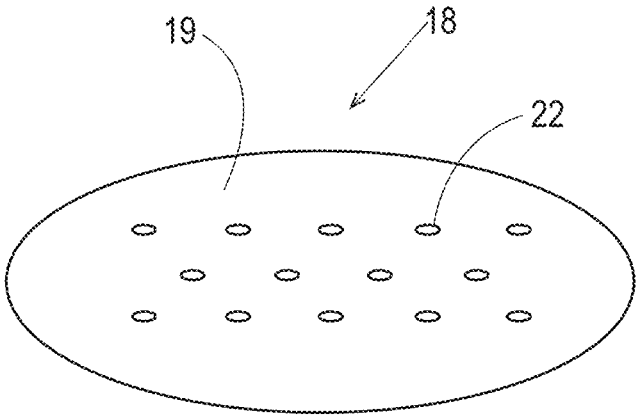
FIG. 2 is a top plan view of the package of FIG. 1.
Figure 3:
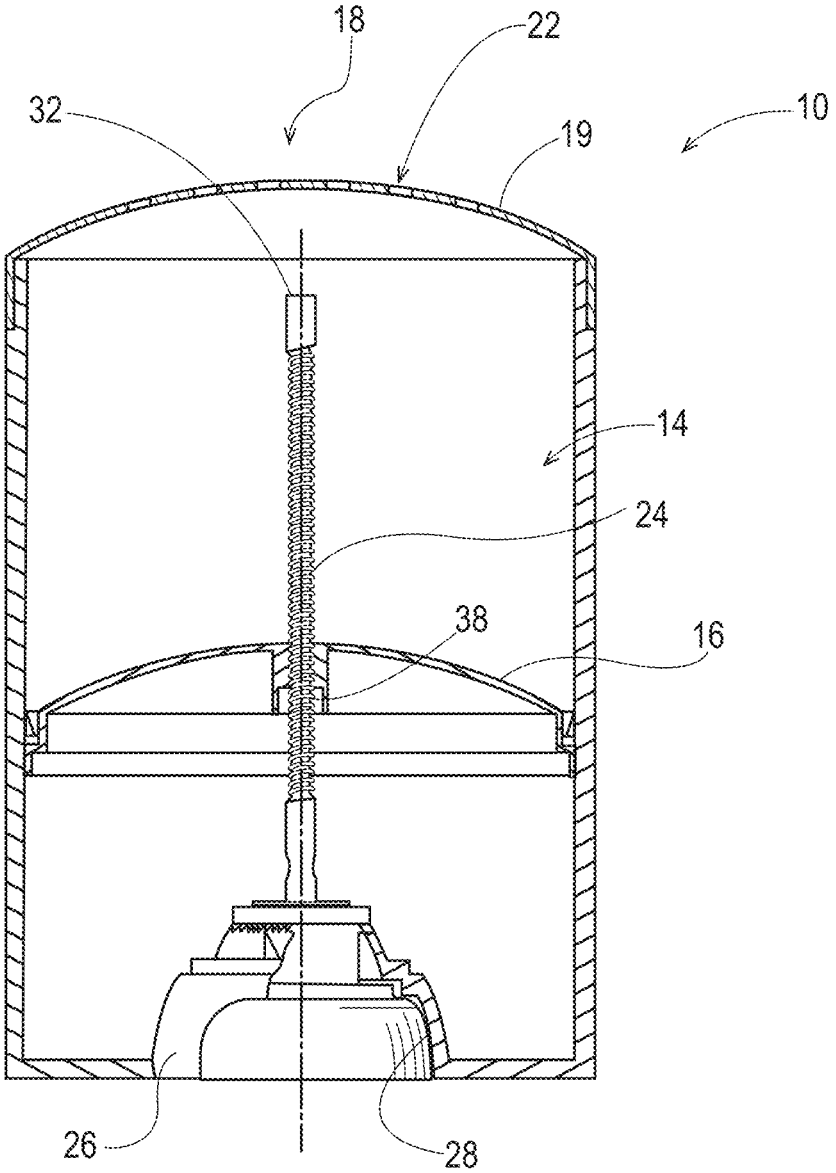
FIG. 3 is a cross-sectional, side elevational view of the package of FIG. 1, taken along line 3-3 thereof.

I. Dispensing Packages a. Container Bodies and Means for Extruding an Antiperspirant Composition Referring now to FIGS. 1 to 3, one example of a dispensing package 10 suitable for use with an antiperspirant composition, preferably a soft solid, antiperspirant composition is shown. The package 10 comprises a container body 12 having an interior chamber 14 which may be of generally uniform or symmetrical cross section and which contains an antiperspirant composition. While FIGS. 1 to 3 depict the container body as formed from a single wall, it is contemplated that the container body 12 may be formed from 2 or more walls, such as, for example, the double walled design described in U.S. Pat. No. 8,388,249. An elevator 16 having a cross section congruent to the interior chamber 14 is mounted for movement within the interior chamber 14. The elevator may move along the longitudinal axis of the package. In addition to an axial movement, the elevator may also be provided with other movements, such as for example a rotational movement or a combination of rotational and axial movements. A dome 18 having a top or application surface 19 is affixed or attached to a first or dispensing end of the container body 12. A cap (not shown) may cover the dome 18. The dome 18 has a plurality of apertures 22 extending through the thickness of the dome 18. In some embodiments, the applicator surface of the dome 18 may be convexly (or slightly convexly) shaped or flat, although a wide variety of other surface shapes and configurations may be provided. The applicator surface 19 is immobile relative to the container body 12 so that the solid portions of the surface may be used to shear the antiperspirant composition onto the skin surface during use. The applicator surface 19 is typically sized for application to the axilla (e.g., in some instances having a length or major axis of about 4 to 6 cm and a width or minor axis of about 2 to 4 cm in top plan view).

A means for advancing the elevator 16 toward the dome 18 to expel the antiperspirant composition through the apertures is also provided. Such means are well known in the packaging and antiperspirant art and may comprise a threaded feed screw 24 which advances the elevator 16 toward the dome 18. While a feed screw is shown for purposes of illustration, other mechanisms (e.g., a ratchet and pawl) known in the an may be employed for advancing the elevator toward the dome. Some examples of other means are described in USPNs 2003/0029889 and U.S. Pat. No. 8,235,615. The elevator 16 typically represents the bottom of the dispensing package on or above which the antiperspirant composition rests prior to dispensing.

Briefly, the feed screw 24 may be actuated by rotating a hand wheel 26 that is operatively connected to the feed screw 24. In some instances, the feed screw is integrally formed with or integrally connected to the hand wheel. The hand wheel is preferably disposed opposite the dome 18. In use, the hand wheel 26 is rotated, thereby rotating the feed screw 24. Since the elevator 16 is housed within the container body 12, rotation of the feed screw 24 causes the elevator 16 to move along the feed screw 24, thus forcing the antiperspirant composition through the apertures 22 in the dome 18. The hand wheel 26 may be held within a recess 28 formed externally of a second end 30 of the container body 12. The recess 28 is formed to house the hand wheel 26 therein, while permitting a user to engage and rotate the hand wheel 26 when the user desires to dispense the antiperspirant composition. While a hand wheel 26 is shown for purposes of illustration, it will be appreciated that other means for rotating the feed screw 26 may be utilized, as known in the art.

The feed screw 24 has a first end 32 and a second end 34. The second end 34 of the feed screw 24 extends through opening 36 in the second end 34 of the container body 12 and is coupled to the hand wheel 26. In this way, the feed screw 24 is rotated when the hand wheel 26 is rotated by a user. The first end 32 of the feed screw 24 extends within the container body 12 such that the elevator 16 may ride on the feed screw 24 until it reaches a desired position adjacent the first end 32 of the feed screw. The elevator 16 includes a threaded central opening 38 shaped and sized to threadably receive the feed screw 24. The package 10 may further comprise a pressure relief mechanism that automatically relieves residual pressure on the antiperspirant composition, such as by intermittently retracting the elevator as described in one or more of U.S. Pat. Nos. 4,356,938 and 5,000,356.

The package may be configured to dispense a wide range of antiperspirant doses, such as for example, between about 0.1 grams to about 0.6 grams per use. However, in some instances, it may be desirable to provide a reduced dosage in order to provide an enhanced light and dry feeling, particularly with some of the soft solid antiperspirant compositions described hereafter. In these instances, the package may be configured to dispense a dose of the antiperspirant composition that is less than 0.4 grams and more preferably between about 0.1 grams and about 0.3 grams or between about 0.15 grams and about 0.3 grams, although higher doses may also be dispensed. As the antiperspirant composition dosage is reduced, it is believed that the feel imparted by the dome or applicator surface may become a bigger factor in the consumer experience during use. It is also believed that reducing the dosage of the antiperspirant composition may further improve the dry feel of a soft solid antiperspirant composition as well as help reduce the appearance of residue in a high solids antiperspirant composition.

b. Domes

The antiperspirant compositions described herein are stored within a dispensing package having a dome comprising a thermally conductive material. The term "dome" is used herein in its broadest sense and merely refers to any single or multi-piece and/or single or multi-material structure of any shape or size or configuration that closes one end of the container body 12 and through which the antiperspirant composition is dispensed. The top or application surface of the dome may be flat or curved or any shape or conformation. The top or application surface of the dome may be smooth or textured. The solid portions of the top surface of the dome are useful for shearing the antiperspirant composition into the axilla during use. It is believed that a dome comprising one or more thermally conductive materials may improve consumer delight at the time of application of a various antiperspirant compositions, particularly soft solid antiperspirant compositions.

Certain thermally conductive materials were qualitatively assessed in the following test. Two anhydrous soft solid antiperspirant compositions were each placed with twenty-five male roll-on users, ages 18 to 45, over a three to five day test usage period. The users were instructed to apply the equivalent of approximately 0.28 grams of antiperspirant composition per use. Following the test usage period, the users were asked to rate various technical attributes of the antiperspirant products. Both antiperspirant compositions were the same and comprised cyclopentasiloxane (32.75% w/w), aluminum chlorohydrate (86% active at 28% w/w), tapioca starch (19% w/w), 50 cs dimethicone (10% w/w), petrolatum (3% complexed betacyclodextrin (3% w/w), tribehenin (1.2% w/w), stearyl alcohol (1% w/w), PPG-14 butyl ether (1% w/w), perfume (0.75% w/w) and C18-36 triglyceride available under the trade name Syncrowax HGL-C (0.3% w/w). Both antiperspirant compositions comprised about 52.5% w/w solids in combination with volatile and non-volatile silicone fluids so as to provide a soft solid antiperspirant composition perceived to have a lighter/drier feel than more traditional soft solid antiperspirant compositions. The first antiperspirant product utilized a package having a polypropylene dome, while the second antiperspirant product utilized a package having a similarly configured dome machined from aluminum. Polypropylene may be described as a thermal insulator and typically has a thermal conductivity, k, of 0.1 to 0.22 W/m·K at 23° C. In contrast, aluminum is highly thermally conductive and may typically have a thermal conductivity k of 200 to 240 W/m·K at 23° C. Some of the questions asked of the users and their corresponding average rating response (on scale from 0 to 100) following the usage period are reproduced below in Table 1 for the first antiperspirant product, the second antiperspirant product and the users' current roll-on product (which was not part of the usage test). Also, the overall average rating for each product (which takes into account other attributes not set forth in Table 1) is also provided.

TABLE 1

| Question | Rating For Users' Roll-On | Rating For First Package With Polypropylene Dome | Rating For Second Package With Aluminum Dome |
|---|---|---|---|
| Overall Rating | 61 | 70 | 75 |
| Ability to control where product is applied | 63 | 69 | 74 |
| For covering my entire underarm | 61 | 78 | 80 |
| Drying quickly | 49 | 70 | 74 |
| Not feeling sticky when applied | 5 | 74 | 79 |
| Feels refreshing and cool when applied | 51 | 56 | 76 |
| Dries quickly after application | 44 | 70 | 74 |

Surprisingly, the aluminum dome provided a significant increase in the refreshing and cool rating of the product versus both the polypropylene dome as well as the user's current roll-on antiperspirant product. This may be considered surprising from the perspective that roll-on antiperspirant compositions contain high concentrations of water and/or humectants (e.g., typically greater than 20%, 30%, 40% or 50% w/w of the composition) which often results in a cool feeling at time of application (due to heat extraction from the skin provided by the evaporating water), although roll-on antiperspirant compositions may typically suffer from feeling sticky after application. Yet, surprisingly, the package with the aluminum dome bested the roll-on rating for "feels refreshing and cool when applied" by over 20 pts., while the rating for the package with the polypropylene dome was much closer to that of the roll-on rating (56 v. 51). Rating bumps were also seen for aluminum dome versus the polypropylene dome and/or the current roll-on for the other attributes listed in Table 1, Also notable was the rating bump associated with the ability to control where the composition is applied, further indicating a helpful sensorial queue may have been provided by the aluminum dome. The overall rating jumped 5 points between the polypropylene dome and the aluminum dome, which is also believed to be a meaning full shift that represents a consumer noticeable difference between the products.

In an additional test, fourteen (one of whom dropped out of the portions of the testing) female expert panelists trained to rate and compare cold feel sensory experiences evaluated the cold feel of 8 thermally conductive materials formed into the shape of a flat oval disk approximately the shape of an antiperspirant package dome and then evaluated two of the flat disks formed from thermally conductive polymers in combination with a commercially available gel antiperspirant composition and a commercially available soft solid antiperspirant composition. The gel antiperspirant composition comprised cyclopentasiloxane (0.5% w/w), a 28% aluminum zirconium octachlorohydrate aqueous solution (51.5% w/w), cyclopentasiloxane and PEG/PPG 18/18 dimethicone (7.8% w/w), calcium glycinate (2.45% w/w), calcium chloride (1.2% w/w), propylene glycol (11.8%), ethanol (8.6%), water (7.45%), dimethicone and trisiloxane (7.45% w/w) and fragrance (0.75%). The commercially available soft solid antiperspirant composition comprised cyclopentasiloxane (55.6% w/w), dimethicone (5% w/w), PPG-14 butyl ether (0.5%), petrolatum (3% w/w), tribehenin (4.5% w/w), (18-36 triglyceride (1.13%), complexed beta cyclodextrin (3% w/w) and aluminum zirconium trichlorhydrate glycine powder (26.49% w/w). The following 8 disks were tested without an antiperspirant composition: disk #1 was made completely from aluminum (weight=11.8 grams), disk #2 was made completely from stainless steel (weight=35 grams), disk #3 made completely from Cool Poly® D1202 (k=5 W/m·K and weight=5 grams), disk #4 made completely from Cool Poly® E1201 (k=10 W/m·K and weight=5.4 grains), disk #5 made completely from Cool Poly® E3607 (k=20 W/m·K and weight=7.1 grams), disk #6 made completely from Cool Poly® E5125 (k=30 W/m·K and weight=7.9 grams), disk #7 made completely from XTT 6600-01 available from Poly One Corp, USA (k=20 W/m·K and weight=7.5 grams) and disk #8 made completely from polypropylene (k=approximately 0.2 W/m·K and weight=3.9 grams). Disks #3 and #4 were then tested with the gel antiperspirant composition and the soft solid antiperspirant composition. All of the Cool Poly polymers are available from Cool Polymers, Inc. USA.

Figure 4:
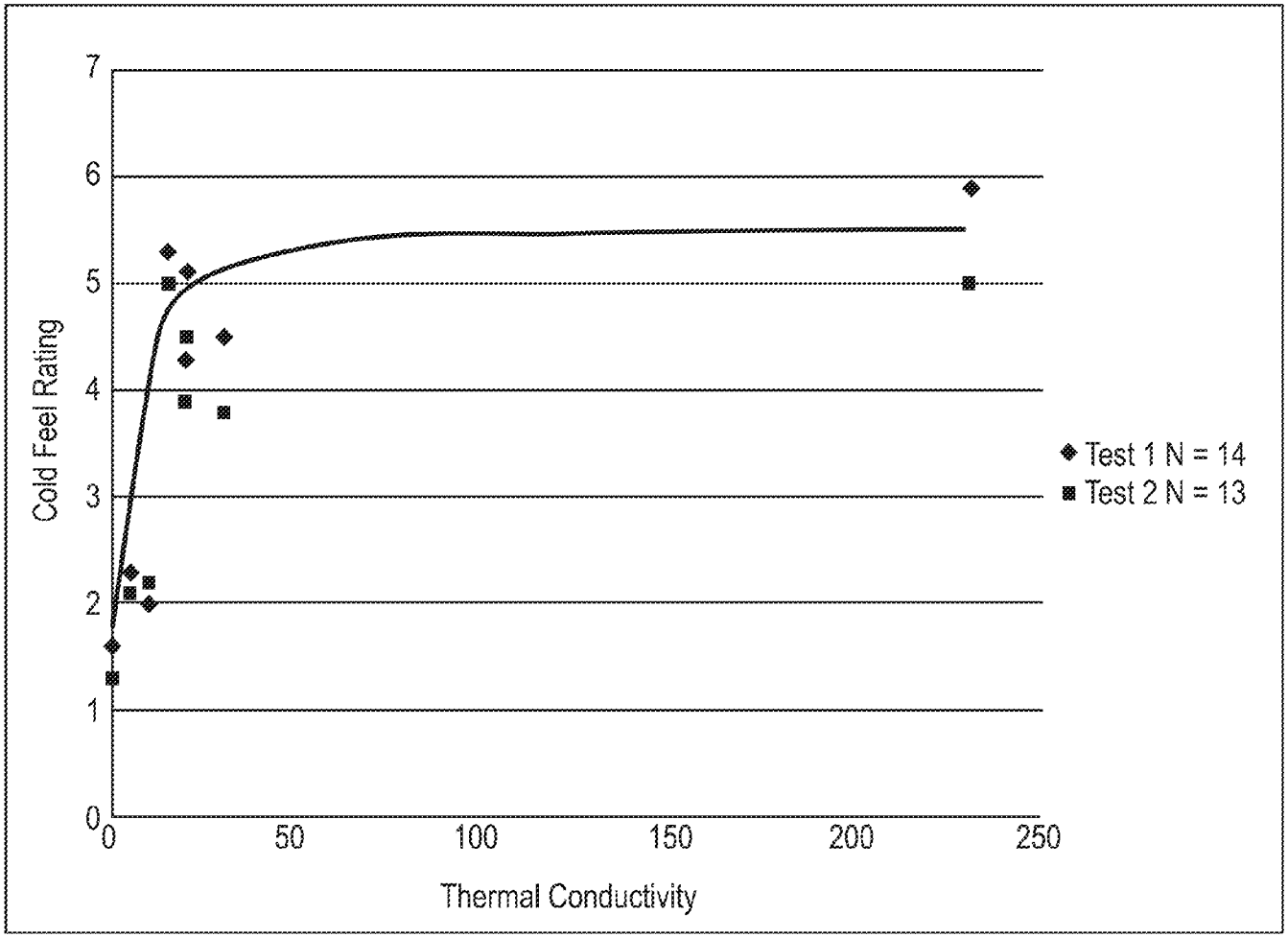
FIG. 4 is a graph of expert axilla cold feel rating versus thermal conductivity of a variety of materials.

In the first part of the test, each of the expert panelists raised her left arm and a test operator applied the disk (without an antiperspirant composition) to the left underarm starting from the top of the underarm down the middle and then back up to the top over a two second period. While the disk was in contact with the skin, the expert panelist evaluated the cold feel on scale from 0-8, 0 being the least cold and 8 being the most cold. These steps were then repeated with the right arm underarm. Fourteen of the female expert panelists evaluated each of the 8 disks, and then thirteen of the female expert panelists again evaluated each of the 8 disks on the following day. Table 2 lists the average cold feel rating for the panelists (right and left underarm) for each day, wherein "a", "b" and "c" represent the statistical significance between the values (for example, the difference between a value labeled as "a" and a value labeled as "c" would be considered statistically significant, meaning having a p=0.5). Interestingly, above a thermal conductivity of about 15 W/k·M to about 20 W/k·M, the ability of the expert panelist to discern a statistically significant difference in cold feel greatly diminishes and the plot of cold feel rating to thermal conductivity seems to trend toward asymptotic, as seen in FIG. 4. The average cool feel ratings for the thermally conductive materials having a k value greater than about 15 W/m·K were considered to be statistically significant versus polypropylene, the D1202 and the E1201 thermally conductive polymers. Said another way, the thermally conductively polymers having a k value less than 10 W/m·K did not provide a statistically different cool feel rating compared to polypropylene, although both were still directionally colder than polypropylene.

TABLE 2

| | Disk Material | k (W/m · K) | N = 14 Avg. Rating | N = 13 Avg. Rating |
|---|---|---|---|---|
| Disk #1 | Aluminum | 230 | 5.9 ab | 5 a |
| Disk #2 | Stainless Steel | 15 | 5.3 ab | 5 ab |

TABLE 2-continued

| | Disk Material | k (W/m · K) | N = 14 Avg. Rating | N = 13 Avg. Rating |
|---|---|---|---|---|
| Disk #3 | D1202 | 5 | 2.3 c | 2.1 c |
| Disk #4 | E1201 | 10 | 2 c | 2.2 c |
| Disk #5 | E3607 | 20 | 5.1 ab | 4.5 ab |
| Disk #6 | E5125 | 30 | 4.5 ab | 3.8 b |
| Disk #7 | H XTT 6600-001 | 20 | 4.3 b | 3.9 ab |
| Disk #8 | Polypropylene | 0.2 | 1.6 c | 1.3 c |

In the second part of the test, fourteen of the female expert panelists tested the commercially available soft solid antiperspirant composition with disks #3, #4 and #8 and thirteen of the female expert panelists tested the commercially available gel antiperspirant composition with the same disks on the following day. The panel operator added 0.3 grams of either the gel antiperspirant composition or the soft solid antiperspirant composition to the disks, and the panelists evaluated each disk under both the left and right underarms using the same procedure as previously described. Table 3 lists the average cold feel rating for the panelists for these combinations, wherein "a", "b" and "c" represent the statistical significance between the values (for example, the difference between a value labeled as "a" and a value labeled as "c" would be considered statistically significant, meaning having a p=0.5).

TABLE 3

| | Disk Material | k (W/m · K) | Gel Avg. Rating | Soft Solid Avg. Rating |
|---|---|---|---|---|
| Disk #3 | D1202 | 5 | 5.8 a | 3.2 ab |
| Disk #4 | E1201 | 10 | 5.7 a | 3.6 a |
| Disk #8 | Polypropylene | 0.2 | 5.7 a | 2.8 b |

Interestingly, neither of the thermally conductive polymers tested provided a statistically significant difference from the polypropylene disk when tested with the gel antiperspirant composition, with all of the average rating values being relatively close. Without intending to be bound by any theory, it is believed that the cool feeling provided by a gel type antiperspirant composition due to the high water and/or humectants concentrations may dwarf the ability of at least the tested thermally conductive polymers to provide a noticeable benefit in the axilla. Thus, it is believed that the thermally conductive materials having a k value from about 5 W/m·K to about 10 W/m·K may not be as useful with gel antiperspirant compositions. Turning to the soft solid antiperspirant composition results, disk #4 made from the E1201 thermally conductive polymer provided a statistically significant increase in cold feel compared to the polypropylene disk #8, while disk #3 made from the D1202 thermally conductive polymer provided a directional increase. Interestingly, disks #3 and #4 performed nearly identically and neither was statistically significant compared to polypropylene, in the first part of the test when tested without a antiperspirant composition. Without intending to be bound by any theory, it appears that utilizing thermally conductive materials having a k value greater than about 5 W/k·M may provide a noticeable cold feel difference compared to a thermally insulating material, such as polypropylene, when used in combination with an anhydrous antiperspirant composition or a soft solid antiperspirant composition or antiperspirant compositions other than a gel or emulsion.

In accordance with one aspect of the invention, at least the top surface of a dome, and in some instances the entire dome, is formed in whole or part from one or more thermally conductive materials when used in combination with antiperspirant compositions other than gels and emulsions. In addition or alternatively, the antiperspirant composition is anhydrous and/or a soft solid antiperspirant composition. The dome, or the one or more thermally conductive materials used to form the dome, may have a thermal conductivity, k, from about 5 W/m·K, 6 W/m·K, 8 W/m·K, 10 W/m·K, 15 W/m·K or 20 W/m·K to about 300 W/m·K, 250 W/m·K, 200 W/m·K, 150 W/m·K, 100 W/m·K, 75 W/m·K, 50 W/m·K, 40 W/m·K, 30 W/m·K or 20 W/m·K. Preferably, the thermally conductive material has a k value greater than about 5, 10, 15, or 20 W/m·K and/or less than about 100, 50 or 30 W/m·K. Some examples of a thermally conductive material suitable for forming the dome, or a portion thereof, include a metal, a metal alloy, a thermally conductive polymer or a combination thereof, although it will be appreciated that other thermally conductive materials may also be used. Some non-limiting examples of metallic materials that may be suitable for use include aluminum and stainless steel, which may have k value from 200 to 240 W/m·K and 16 to 18 W/m·K, respectively. For thermally conductive domes comprising a metal in whole or part, the thermal conductivity k may be from about 10 to 300 W/m·K.

In contrast to the thermally conductive materials described above, many conventional plastic materials may be considered thermal insulators and have a thermal conductivity of less than 0.5 W/m·K. For example, polyamide (Nylon 6) may have a k value from 0.24 to 0.26 W/m·K at 23° C., high density polyethylene may have a k value from 0.45 to 0.52 W/m·K at 23° C., low density polyethylene may have a k value from 0.33 W/m·K at 23° C., polyethylene terephthalate may have a k value from 0.15 to 0.4 W/m·K at 23° C., polyimide may have a k value from 0.1 to 0.35 W/m·K at 23° C., polypropylene may have a k value from 0.1 to 0.22 W/m·K at 23° C. and polystyrene may have a k value from 0.1 to 0.13 W/m·K at 23° C. while cross linked polystyrene may have a k value from 0.17 W/m·K at 23° C. (see, e.g., Thermal Properties of Plastic Materials available from Professional Plastics, Inc., USA). Domes of at least some commercially available antiperspirant packages are presently manufactured from polypropylene or polyethylene terepthalate.

It may be desirable for the thermally conductive material to have a mass greater than 0.5 grams, particularly in the case of metals, or greater than 3 grams in the case of thermally conductive polymers in order to provide a sufficient cooling sensation during the application period. In some instances, the mass of the thermally conductive material is from about 0.5, 0.75, 1, 2, 3, 4, 5, or 6 grams to about 40, 30, 20, 15 or 10 grams. A preferred range for the mass of the thermally conductive material is from about 1 gram to about 15 grams.

In some instances, the dome may be formed in whole or part from a thermally conductive polymer composition. The thermally conductive polymer composition may be injection moldable, so that the dome may be formed as a separate piece that is attachable (e.g., by press fit or a male/female notch and tab arrangement) to the container body. In this way, only the dome need be formed from the thermally conductive material versus forming the entire container from the thermally conductive material, although it will be appreciated that the dome and container may be formed from the same material if desired. The dome may be made as a single piece by injection molding or thermoforming one or more thermally conductive polymer compositions, in which case the dome is formed substantially or completely of one or more thermally conductive polymer compositions. The thermally conductive polymer composition may form at least a portion of the top or application surface of the dome and more preferably may form from about 50%, 60%, 70% or 80% to about 100%, 90% or 80% of the surface area of the top or application surface of dome.

In some instances, it may be desirable for the dome to be formed as a multi-piece or multi-material structure or to otherwise include materials other than the thermally conductive polymer composition. For example, in some instances it may be desirable to apply a very thin (e.g., less than about 0.2 mm) metal, metal alloy or other metallic layer on top of the thermally conductive polymer composition to enhance the appearance of the top or application surface of the dome, perhaps to give the thermally conductive polymer composition more of a metallic appearance as a visual queue for its cooling properties. The thermally conductive polymer composition may therefore act as a substrate for the metal layer. The metal layer may be applied, for example, by metal spraying or other deposition techniques. In these instances, the metal layer may form at least a portion of the top or application surface of the dome, or the metal or metal alloy layer may form from about 50%, 60%, 70% or 80% to about 100%, 90% or 80% of the surface area of the top or application surface of dome.

Figure 5:
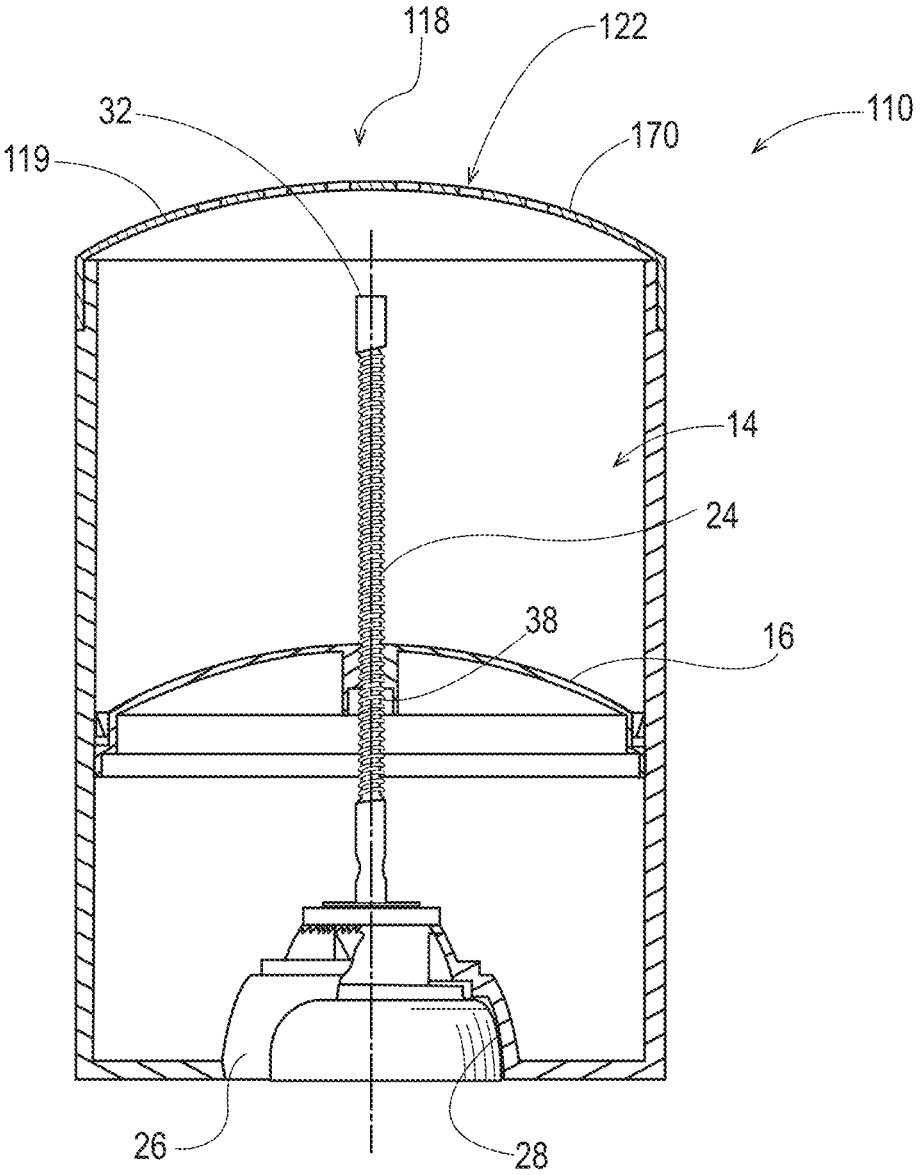
FIG. 5 is a cross-sectional side elevational view of package having a dome formed from two layers.

With reference to FIG. 5, in another embodiment, a lower portion 170 or underside of the dome 118 may be formed from one or more polymers having a thermal conductivity less than 1.5 W/m·K, or less than 1 W/m·K or less than 0.5 W/m·K while the top portion 172 of the dome 118 that forms the top or application surface 119 that contacts the skin is formed from a thermally conductive material that provides a cool feeling during use. For example, the top portion might be formed by a thicker metal layer than described above or a thermally conductive polymer composition so that the top layer provides a cool feeling during use.

Figure 6:
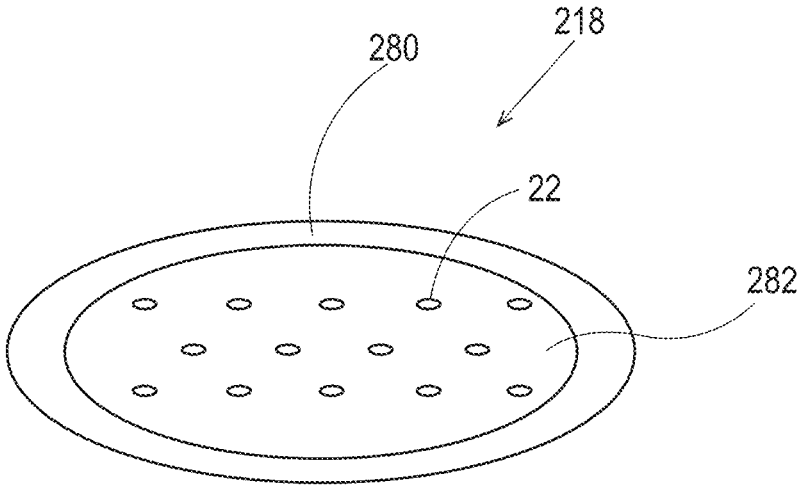
FIG. 6 is top view of a dome having an outer ring and an inner portion formed from a thermally conductive material.

In some other embodiments, the top or application surface of the dome may be made in part by a thermally conductive material, as shown by way of example in FIG. 6, and in part from a thermally insulating material. The applicator surface 219 of dome 218 comprises an outer ring 280 formed by a material (e.g., polypropylene) having a thermal conductivity less than 1.5 W/m·K, or less than 1 W/m·K or less than 0.5 W/m·K while an inner portion 282 of the upper applicator surface 219 might be formed by a thermally conductive material (e.g., a thermally conductive polymer) having a thermal conductivity greater than about 5 W/m·K. This latter configuration might also be formed, for example, by a two shot molding process.

Thermally conductive polymer compositions typically comprise a base polymer matrix that has been loaded with a variety of thermally conductive fillers, such as, for example, metal oxides (e.g., alumina, magnesium oxide, zinc oxide and titanium oxide), ceramics (e.g., silicon nitride, aluminum nitride, boron nitride, boron carbide), carbon materials (e.g., carbon black or graphite), metals (e.g., aluminum, copper and stainless steel) and combinations thereof. The base polymer matrix may comprise one or more polymers, and in some instances may comprise a plurality of polymers. For example, the base polymer matrix may comprise injection molding grade polybutylene terephthalate in combination with a polyether ester elastomer, a polyamide in combination with a polyether amide elastomer or a polypropylene in combination with a thermoplastic olefinic elastomer. Some examples of thermally conductive polymer compositions that may be suitable for use are described in USPNs 2003/0040563; U.S. Pat. Nos. 7,655,719; and 8,221, 885 and/or are available under the trade names of Cool-Poly® D and E Series available from Cool Polymers, Inc., USA. In some instances, the entire applicator surface of the dome is formed from a thermally conductive material and, more preferably the entire dome is formed from a thermally conductive material so as to provide sufficient thermal mass to provide a cooling sensation.

In some embodiments, the dome may have from 1, 2, 3, 4, 10, 20 or 30 to about 200, 100, 80, 60, 40 or 30 apertures 22. The term "apertures" is used herein in its broadest sense and includes any hole, perforation, slot or opening of any shape or size or number or pattern in the dome 18. The apertures extend from the top surface of the dome through the thickness of the dome to a bottom surface thereof. In instances where it may be desirable to provide a low dose of the antiperspirant composition to further enhance the light and dry feeling of the composition in use, the dome may have from about 4, 5, or 6 to about 12, 10, 8 or 7 apertures 22. The apertures 22 may be distributed evenly over the dome or not. The apertures may be the same size or not. In instances where fewer apertures are desired for low dosing, the total open area of the apertures may be from about 50 $mm^2$, 55 $mm^2$, 60 $mm^2$ to about 100 $mm^2$, 90 $mm^2$ or 80 $mm^2$. The apertures may have a circular or noncircular configuration, preferably a substantially circular (e.g., circular or oval or elliptical) configuration having an average or equivalent circular diameter from about 2 mm to about 6 mm. While the FIGS. illustrate a dome having a plurality of apertures for convenience, it is contemplated that in some instances only one aperture may be provided. In these latter instances, the aperture may have a diameter less about 10 mm and/or an open area less than about 80 $mm^2$ and/or the solid surface area of the top surface of the dome may be greater than 80%, 90%, 96% or 98% of the total surface of the top surface of the dome.

II. Antiperspirant Compositions

The packages described herein contain an antiperspirant composition that is expellable, which in addition to its plain meaning also includes pushed or extruded or shaved, through an apertured dome. The antiperspirant compositions may be a soft solid antiperspirant composition, or an antiperspirant composition other than a gel or an emulsion. Some examples of antiperspirant compositions suitable for use are described in U.S. Pat. Nos. 5,843,414; 6,426,062; 6,849,251; 2012/156,152 and 2013/189,208 and commonly assigned and co-pending U.S. Ser. No. 14/090,175 filed Nov. 26, 2013. These antiperspirant compositions generally lack sufficient structure and/or viscosity to be self supporting during the application process while still having too much structure or viscosity to be dosed to the skin as a free flowing liquid, like a roll-on antiperspirant composition which may have a viscosity of less than 2,000 centipoise. These antiperspirant compositions generally comprise an antiperspirant active and one or more structurants. The total concentration of structurants may be from about 0.5%, 1%, 2%, 3%, 4%, 5% or 6% to about 20%, 15%, 10% or 7% by weight of the antiperspirant composition, depending upon the type of structurants and the and method of making. In many instances, the total concentration of structurants is less than 10%, or less than 7% or less than 6% or less than 5% or less than 4% by weight of the antiperspirant composition. These antiperspirant compositions may further comprise one or more volatile or non-volatile carriers and optionally one or more solids or fillers and/or perfumes. Structurants may broadly include waxes, including but not limited to fatty alcohols, triglycerides, microcrystalline waxes, paraffin waxes, polyethylene and polymethylene waxes. Many more examples of suitable waxes are also described hereafter. Structurants may further include inorganic thickening agents such as fumed or precipitated silicas, hydrophobically modified silicas, clays such as bentonite, hectorite or montmorillonite clays and hydrophobically modified versions of those clays such as quaterinum-18 hectorite. Moreover, structurants may include but are not limited to polymers such as silicone elastomers or cross polymers, polyamides, silicone polyamides, polyacrylate and styrene/butadiene copolymers. Other solids that may optionally be included in the antiperspirant composition include starch powders, celluloses, talcs, polyethylene powders and solid fragrance deliver systems including but not limited to cyclodextrins and a wide variety of microcapsules containing a perfume. Carriers may, for example, broadly include one or more of water, volatile and non-volatile silicones, emollients and residue masking agents which are typically liquids with a refractive index greater than 1.4. These antiperspirant compositions may also be anhydrous, although there may be water present that is bound to the antiperspirant active and/or hydrophilic powders (if present) or other ingredients. The antiperspirant composition may have a water content of about 10% or less; about 8% or less; about 7% or less; about 5% or less; or about 3% or less from water brought in with the raw materials.

While various antiperspirant compositions may be beneficially used with the packages described herein, including a wide variety of soft solid antiperspirant compositions including but not limited to pastes and creams, the antiperspirant compositions described in co-pending U.S. Ser. No. 14/090,175 (and discussed below for purposes of illustration and convenience) may also benefit greatly from incorporating a dome comprising one or more thermally conductive materials due to the dry and light feel of these compositions. The cool sensation provided by a thermally conductive material may provide the added benefit of providing a helpful sensorial queue to the consumer that the antiperspirant composition has been adequately applied to a particular skin surface. However, it should be appreciated that the soft solid antiperspirant compositions described hereafter are not the only soft solid antiperspirant compositions suitable for use with the present invention.

A. Solids in Certain Soft Solid Antiperspirant Compositions

Soft solid, as an antiperspirant form, is well liked by many consumers. In fact, once certain consumers use this form, they are very loyal to it in spite of its drawbacks. At least partially due to formulation limitations, some soft solid products may often leave a tacky feeling after application. In contrast, some consumers desire an antiperspirant composition that approaches feeling more like a powder (light and dry) at application. There may also be some difficulties applying antiperspirant compositions through hair and to wet skin. This can be a particular problem for male users, as they may tend to have more hair in the axilla area and/or may be less prone to dry the axilla prior to applying an antiperspirant composition. It is believed that at least some of these drawbacks may be overcome by balancing the solids level and type, viscosity, wax type and level, and/or hydrophilic water insoluble oil levels.

Figure 7:
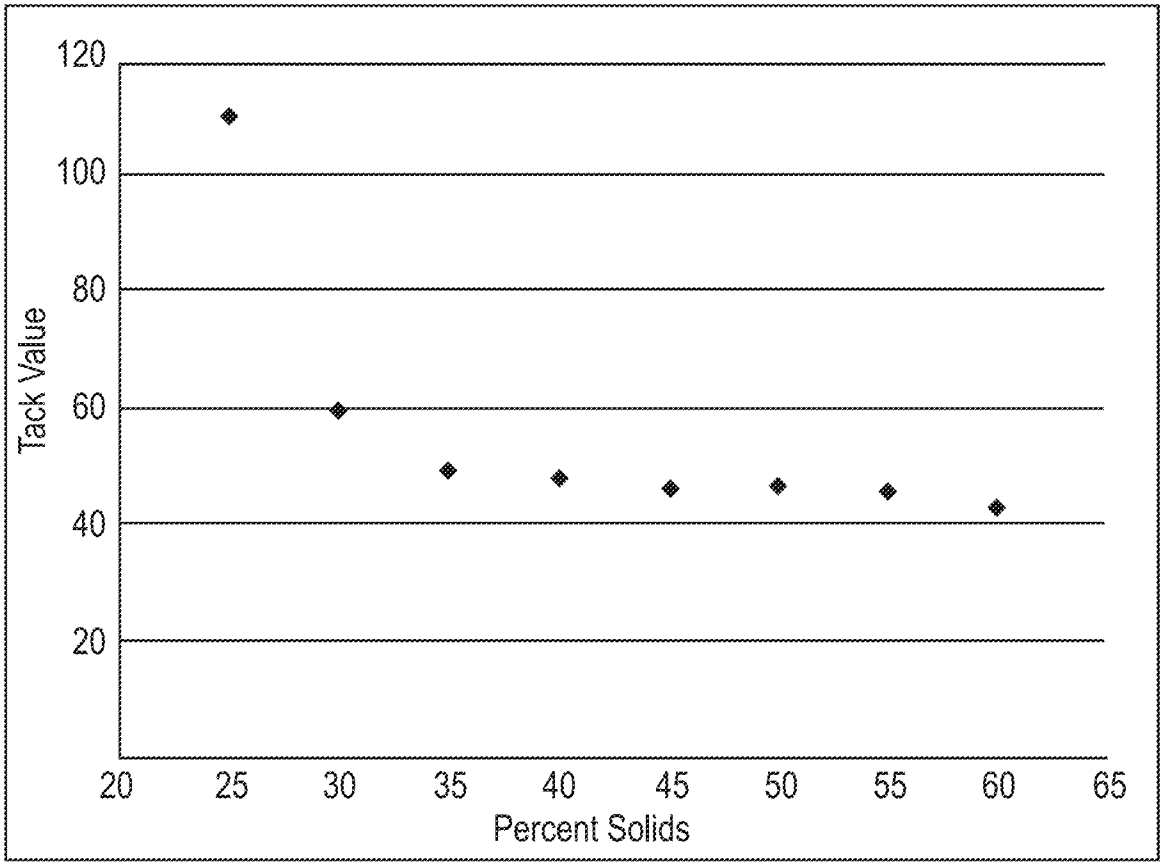
FIG. 7 is a graph showing tack value (gF, gram Force) as a function of percent solids (antiperspirant active and filler) in an antiperspirant composition.

One approach to help alleviate the feeling of tackiness upon application of a soft solid type antiperspirant composition and/or provide a dry/light feel, is to increase the solids level of the antiperspirant composition. It is believed that these solids reduce skin to skin adhesion in the axilla, thereby reducing the feeling of stickiness or tack when the composition is applied. As can be seen from FIG. 7, there is a general reduction in tack in soft solid compositions as the solids level is increased. The antiperspirant compositions of FIG. 7 comprised aluminum chlorohydrate (25% w/w), 50 centistoke dimethicone (5% w/w), stearly alcohol (1% w/w), Syncrowax HGLC (0.5% w/w), hydrogenated high euricic acid rapeseed oil (2% w/w), cyclopentasiloxane (variable w/w %) and hydrophilic tapioca starch (variable w/w %). The compositions representing the data points in FIG. 7 comprised (from left to right in the FIG.): 0% hydrophilic tapioca starch and 66.5% cyclopentasiloxane; 5% hydrophilic tapioca starch and 61.5% cyclopentasiloxane; 10% hydrophilic tapioca starch and 56.5% cyclopentasiloxane; 15% hydrophilic tapioca starch and 51.5% cyclopentasiloxane; 20% hydrophilic tapioca starch and 46.5% cyclopentasiloxane; 25% hydrophilic tapioca starch and 41.5% cyclopentasiloxane; 30% hydrophilic tapioca starch and 36.5% cyclopentasiloxane; and 35% hydrophilic tapioca starch and 31.5% cyclopentasiloxane. The percent solids shown on the x-axis represents the combination of the antiperspirant active and the hydrophilic tapioca starch and does not take into account the wax solids (3.5% w/w/), which were held constant across the compositions. Thus, the solids level was increased by increasing the tapioca starch concentration and reducing the concentration of the cyclopentasiloxane. A similar level of tack is seen between about 40% and 60% solids. Below about 30% solids, the tack increases due to a higher level of liquids in the composition. It is believed that liquids are not as efficient at preventing contact between two surfaces in the underarm which can give rise to a higher level of tack. Analysis of two commercial soft solids Secret® Clinical Strength (ingredients are approximately 55% w/w cyclopentasiloxane, 5% w/w dimethicone, 0.5% PPG-14 butyl ether, 3% w/w petrolatum, 4.5% w/w hydrogenated high euricic acid rapeseed oil, 1% w/w Syncrowax HGLC, 3% beta cyclodextrin fragrance material, 0.75% perfume and 26% IZAG antiperspirant active, wherein total solids are about 35% w/w and total waxes are about 5.6% w/w) and Dove® Clinical Protection, shows tack values of 111 gF and 116 gF, respectively. Both of these compositions have tack values higher than the soft solid compositions with between about 40% and 60% solids shown in FIG. 7. Thus, in some instances it may be desirable for the soft solid antiperspirant composition to have a tack value of about 110 gF, 100 gF, 80 gF or less, about 70 gF or less, about 60 gF or less, or about 50 gF or less. Other exemplary tack values include from about 10 gF to about 80 gF, from about 10 gF to about 70 gF, from about 10 gF to about 60 gF, from about 40 gF to about 60 gF, or any combination thereof.

In some instances, the soft solid antiperspirant composition may comprise from 40% to about 60%, by weight of the antiperspirant composition, of total solids. Further the antiperspirant composition may comprise from about 45% to about 60% or from about 50% to about 60%, by weight of the composition, of total solids. It is believed that solid concentrations above 60%, even with hydrophobic excipient particles, may become too thick to be effectively rubbed across the entire axillia (e.g., typically 65 $cm^2$ to 125 $cm^2$) and/or require undesirably high forces to extrude the antiperspirant composition through the apertured dome of a package. It is believed that solids concentrations less than 40% may tend to provide less of a dry and light feel that more closely approximates application of powder alone. In some instances where it may be desirable to formulate toward the lower end of the solids concentration range described herein, it may also be desirable to then increase the wax concentration toward the higher end of the ranges described herein. Solids may comprise or consist essentially of an antiperspirant active and one or more non-antiperspirant active solids, such as for example one or more waxes and one or more an fillers. Solids may further comprise or consist essentially of fragrance delivery particles.

Fillers

In some instances, the antiperspirant compositions may comprise one or more fillers or excipient powders. The fillers are particulates which would not otherwise substantially thicken an antiperspirant composition at low concentrations (e.g., less than 4% w/w for clays or silicas that: are activated, are in the presence of significant concentrations of free water, milled and/or have a high surface area per gram). Fillers may be chemically inert, reduce the tack of the formula, and/or increase the dry feel of the composition. Fillers exclude clays and silicas added to an antiperspirant composition as bulking or suspending agents, such as organo modified clays activated by a clay activator (e.g, triethyl citrate or methanol or ethanol or propylene carbonate) or silicas with more than 90 to 100 $meters^2$ of surface area per gram, such as, for example, fumed silica. Some examples of organo-modified clays include modified bentonite, modified hectorite and modified montorlinite, some examples of which are available under the trade names Bentone 27 (stearalkonium bentonite), Bentone 34 (stearalkonium bentonite), and Bentone 38 (disteardimonium hectorite) from Elmentis Specialities Plc. And Tixogel VPV (quarternium 90-bentonite), Toxogel VZV (stearalkonium benotine), Toxogel LGM (stearalkonium bentonite) and Claytone SO (stearalkonium bentonite) from Southern Clay Products. Non-organo modified clays, such as for example bentonite or hectorite, may be considered fillers and suitable for use herein as the described antiperspirant compositions are anhydrous and therefore may not have enough free water for all of clay to swell to act as a thickener, although it is believed that even such clays may not be preferred in instances where the composition is applied to wet skin and hair unless a polar wax is included in the composition (e.g., for the same reason it is desirable to include a polar wax with a hydrophilic starch). Silicas having less than 90, 80, 70, 60 or 50 $meters^2$ of surface area per gram might be used as fillers in some instances. Fillers are also distinct from the antiperspirant active.

Fillers may be hydrophobic or hydrophilic, although hydrophilic powders are generally preferred. Hydrophilic powders may enhance antiperspirant active efficacy by improving water transport into the antiperspirant composition during a sweat event. Hydrophilic powders, at the concentrations described herein, however may also increase the risk of the antiperspirant composition balling up on wet hair/skin surfaces due interaction between the powder, water and the antiperspirant active, as it is believed that men may often apply antiperspirant compositions to wet hair and/or skin surfaces. An antiperspirant composition may comprise one or more fillers which, as a raw material ingredient, comprises or consists essentially of hydrophilic powder, hydrophobic powder, a hydrophobically modified powder, or a mixture thereof. Fillers can have an average particle size of about 50 microns or less and are usually free flowing. The extent of hydrophobicity or hydrophilicity, particle shape and amount of particle to particle interaction are believed to influence the aesthetics and/or efficacy of the soft solid antiperspirant composition.

Fillers or non-antiperspirant active powders may be included at a range of about 15% to about 35% or from about 15% to about 25%, by weight of the antiperspirant composition. The amount of filler can be adjusted based on the weight density of the powder. The filler may be charged or uncharged. In one example, an antiperspirant composition comprises an uncharged hydrophobic filler. The filler may have a desired average particle which can be measured according to methods known in the art, like the laser diffraction method.

It is believed that the selection of the fillers may have an impact on the performance of the antiperspirant composition with respect to wet underarms or wet hair in the underarm. The present inventors discovered that the more hydrophilic the filler, the more likely it is to cause the antiperspirant composition to ball-up when being applied to a wet underarm surface. This may be lessened by including a polar wax (e.g., stearyl alcohol) in the antiperspirant composition (particularly in instances where an unmodified, hydrophilic powder is added as a raw material to antiperspirant composition). The polar wax is believed to coat the hydrophilic filler thereby rendering it moderately hydrophobic in the composition. This modified, moderately hydrophobic powder may sufficiently reduce the propensity for balling during rub in while at the same time is not too hydrophobic that these powders significantly reduce water transport into the composition film. Alternatively, a modified, moderately hydrophobic powder (e.g., Dry Flo TS or Dry Flo PC available for AkzoNobel, which are starches modified with silicone or alkyl groups) may be added as a raw material during the antiperspirant composition making process, in which case a polar wax may be excluded from the antiperspirant composition if desired. So hydrophilic powders rendered moderately hydrophobic during the antiperspirant composition making process and moderately hydrophobic powders added as a raw ingredient tend to work the best where an antiperspirant composition will be applied to wet skin or hair as they tend to give better spreadability on those surfaces, although hydrophilic powders may still be included if desired (particularly for female users who are believed to have less of an issue with wet skin and/hair at time of application). At higher solids concentrations (e.g., 55% to 60% w/w), it may be desirable in some instances for the fillers to consist essentially of or completely of hydrophobic powders (e.g., talc) in order to reduce particle to particle interactions with the antiperspirant active during rub in (and the water bound with the active), or, alternatively, it may be desirable to increase the concentration of a polar wax if a hydrophilic filler is utilized as a raw material.

Some examples of acceptable fillers include tapioca starch, corn starch, oat starch, potato starch, wheat starch, any other starches, cellulose powders, microcrystalline cellulose powders, talc, boron nitriles, polyethylene powders, inorganic powders, perfume delivery vehicles, or combinations thereof. While these fillers may be used, starches and perfume delivery vehicles are more preferred than cellulose powders, which may tend to significantly increase low shear rate viscosity (perhaps due to their rod like shapes) and/or may hinder rub in/spreadability of the antiperspirant composition at the solids concentrations described herein.

Within the starch family of materials, further useable classes include native or hydrophobically modified starches. Native starches are generally hydrophilic. Hydrophobically modified starches generally have some surface or cross linking treatment that reduces the availability of a fraction of the polar functional groups making them moderately hydrophobic. One filler believed to be particularly suitable for use is a hydrophilic or hydrophobically modified tapioca starch. Thus, in one example, an antiperspirant composition comprises one or more fillers selected from a hydrophilic tapioca starch, a hydrophobically modified tapioca starch, or a combination thereof. Tapioca is a starch which may be extracted from the cassava plant, typically from the root, which may then be processed or modified as known in the art. Tapioca starch particulates may be round to oval in shape and may have an average particle size about 20 microns, which is believed to add in creating a smooth application feel when the product is rubbed on skin. Thus, in one example, an antiperspirant composition comprises a tapioca starch with an average particle size of about 20 microns or less.

A non-limiting example of a hydrophilic tapioca starch material suitable for use is available under the trade name Tapioca Pure available from AkzoNobel. One non-limiting example of a hydrophobically modified tapioca material suitable for use comprises a silicone grafted tapioca starch, which is available under the tradename Dry Flo TS from AkzoNobel of the Netherlands. The INCI name is tapioca starch polymethylsilsesquioxane and may be produced by a reaction of methyl sodium siliconate (polymethylsilsesquioxane) and tapioca starch. This silicone grafted tapioca starch is commercially available as CAS no. 68989-12-8. Other non-limiting examples of hydrophobically modified tapioca starch materials that are suitable for use include Rheoplus PC 541 (Siam Modified Starch), Acistar RT starch (available from Cargill) and Lorenz 325, Lorenz 326, and Lorenz 810 (available from Lorenz of Brazil).

Another filler believed to be suitable for use is a hydrophilic or hydrophobically modified corn starch. Corn starch particulates may roughly approximate a round or oval shape and may have an average particle size about 15 microns. A non-limiting example of a hydrophilic corn starch material is Farmal CS 3757 available from Ingredion, Inc., USA. There are a wide variety of modified corn starches that can be used, including but not limited, to Dry Flo PC (aluminum starch succinate) and Dry Flo AF (silicone modified starch) both available from Akzo Nobel.

In some instances, the ratio of filler to antiperspirant active is from about 2:1 to about 1:2.

Waxes

The antiperspirant compositions may also comprise one or more waxes. The concentration of the waxes should be high enough to provide sufficient structure (in combination with the high solids level) to the antiperspirant composition while in the package. The wax concentrations may in some instances be from about 1%, 1.5% or 2% to about 7%, 6%, 5%, 4% or 3% by weight of the antiperspirant composition. Most preferred are wax concentrations from about 2% to 5% by weight of the composition. It is believed that higher than about 7% by weight of a wax at the solids concentrations described herein, even when incorporating hydrophobic fillers as a raw material, may result in antiperspirant compositions that are too difficult, in some instances, to dispense through an apertured dome. The wax may be polar, non-polar, or a combination thereof. One exemplary wax combination comprises from about 1.5% to about 3%, by weight of the antiperspirant composition, of a non-polar wax, and from about 0.5% to about 2%, by weight of the composition, of a polar wax. More preferably, the wax combination comprises from about 1.5% to about 3%, by weight of the antiperspirant composition, of a non-polar wax, and from about 0.5% to about 2%, by weight of the composition, of a polar wax, particularly for an antiperspirant composition comprising from about 15% to about 25% of a hydrophilic filler added as a raw material.

In addition, the type of wax (in combination with the type of carriers and fillers included in the antiperspirant composition) may have an impact on syneresis and/or ease of dispensing of the antiperspirant composition and/or balling of the composition on wet skin/hair. Using only polar waxes provided a composition that can be more susceptible to syneresis at low wax levels, such as 2.5% w/w, in combination with a non-polar only liquid carrier, such as a silicone fluid. An example of what happens at lower wax levels in a polar only wax composition with non-polar liquid carriers can be seen in FIG. 8A, where the polar only wax composition (on the far right) is weeping (syneresis) through the apertures in the dispensing portion of the package. This composition comprised aluminum chlorohydrate (28% w/w), hydrophilic tapioca starch (19% w/w), 50 centistoke dimethicone (5% w/w), petrolatum (3% w/w), betacyclodextrins (3% w/w), stearyl alcohol (2.5% w/w), cyclopentasiloxane (38.75% w/w) and fragrance (0.75% w/w).

Figure 8A:
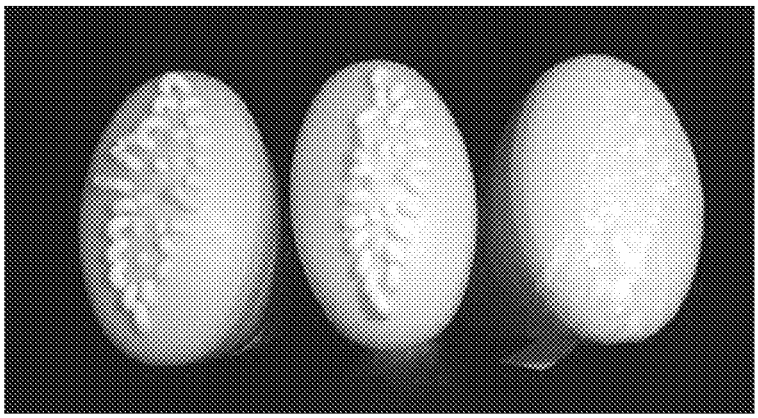
FIG. 8A is a picture of antiperspirant compositions with varying waxes as noted.

It is believed that using only non-polar waxes in combination with a non-polar carrier may avoid syneresis, as shown by the composition shown in the middle of FIG. 8A. This composition comprised aluminum chlorohydrate (28% w/w), hydrophilic tapioca starch (19% w/w), 50 centistoke dimethicone (5% w/w), petrolatum (3% w/w), betacyclodextrins (3% w/w), hydrogenated high euricic acid rapeseed oil (2% w/w), Syncrowax HGLC (0.5% w/w), cyclopentasiloxane (38.75% w/w) and fragrance (0.75% w/w).

Figure 8B:
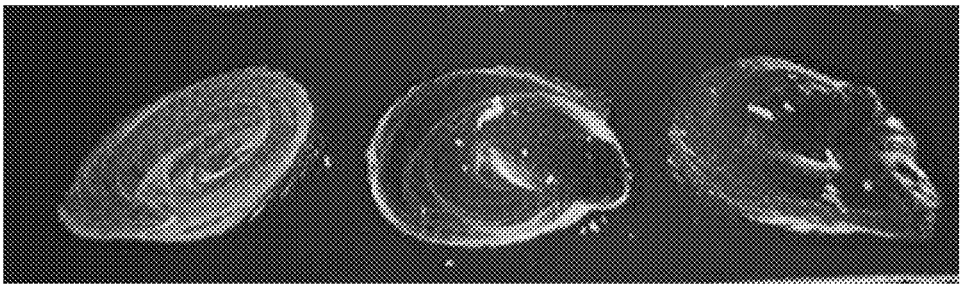
FIG. 8B is a picture of antiperspirant compositions with varying wax levels tested for simulated application to wet skin as discussed herein.

However, utilizing only non-polar waxes may have an additional downside. Namely, the antiperspirant composition may "ball up" or become gritty upon application to wet skin or moist axillia hair when used with a hydrophilic filler added as a raw material. The impact of applying an antiperspirant composition to wet skin is shown in FIG. 8B, wherein 0.2 g of a composition was spread on a piece of naugahyde (an artificial leather material available from Uniroyal Engineered Products LLC), pipeting 10 microliters of water onto the soft solid composition, and mixing the water and soft solid composition. The middle swatch of FIG. 8B (containing the same non-polar wax only wax compositions of FIG. 8A) shows a gritty or balled up appearance (small balls are visible) when subjected to the above-described method. The best composition stability (low/no syneresis) and spreadability/low balling was observed when the composition contained a combination of polar and non-polar waxes, as can be seen in the far left swatches of FIGS. 8A and 8B. This composition comprised aluminum chlorohydrate (28% w/w), hydrophilic tapioca starch (19% w/w), 50 centistoke dimethicone (5% w/w), petrolatum (3% w/w), betacyclodextrins (3% w/w), hydrogenated high euricic acid rapeseed oil (1.2% w/w), Syncrowax HGLC (0.3% w/w), stearyl alcohol (1% w/w), cyclopentasiloxane (38.75% w/w) and fragrance (0.75% w/w). Without intending to be bound by any theory, it is believed that the polar wax blend interacts with the hydrophilic filler to protect it from the effects of water. Surprisingly, the polar wax only composition, in the presence of syneresis, also showed balling as seen in the far right swatch of FIG. 8B. Without intending to be bound by any theory, it is believed that synersis, in some instances, may negate the positive effect of including a polar wax in an antiperspirant composition comprising a hydrophilic filler. As such an antiperspirant composition may comprise in some instances from about 1.5% to about 5%, by weight of the composition, of a non polar wax and from about 0.5% to about 2%, by weight of the composition, of a polar wax, particularly where a hydrophilic filler is also included in the antiperspirant.

Use of only a non-polar wax may be acceptable in instances where the antiperspirant composition comprises fillers consisting essentially of or completely of hydrophophobic or moderately hydrophobic powders added as a raw material.

Waxes may be natural or synthetic materials. Some examples include natural vegetable waxes such as, for example, candelilla wax, carnauba wax, Japan wax, espartograss wax, cork wax, guaruma wax, rice oil wax, sugar cane wax, ouricury wax, montan wax, sunflower wax, fruit waxes, such as orange waxes, lemon waxes, grapefruit wax, bayberry wax, and animal waxes such as, for example, beeswax, shellac wax, spermaceti, wool wax and uropygial fat. Natural waxes may include the mineral waxes, such as ceresine and oncxerite for example, or the petrochemical waxes, for example petrolatum, paraffin waxes and microwaxes. Chemically modified waxes may be used, such as, for example, montan ester waxes, sasol waxes and hydrogenated jojoba waxes. Synthetic waxes include, for example, wax-like polyalkylene waxes and polyethylene glycol waxes.

The wax may also be selected from the group of esters of saturated and/or unsaturated, branched and/or unbranched alkanecarboxylic acids and saturated and/or unsaturated, branched and/or unbranched alcohols, from the group of esters of aromatic carboxylic acids, dicarboxylic acids, tricarboxylic acids and hydroxycarboxylic acids (for example 12-hydroxystearic acid) and saturated and/or unsaturated, branched and/or unbranched alcohols and also from the group of lactides of long-chain hydroxycarboxylic acids. Wax components such as these include, for example, C16-40 alkyl stearates, C20-40 alkyl stearates (for example Kesterwachs (Registered trademark K82H), C20-40 dialkyl esters of dimer acids, C18-38 alkyl hydroxystearoyl stearates or C20-40 alkyl erucates. Other suitable waxes which may be used include C30-50 alkyl beeswax, tristearyl citrate, triisostearyl citrate, stearyl heptanoate, stearyl octanoate, trilauryl citrate, ethylene glycol dipalmitate, ethylene glycol distearate, ethylene glycol di(12-hydroxystearate), stearyl stearate, palmityl stearate, stearyl behenate, cetyl ester, cetearyl behenate and behenyl behenate. Silicone waxes may also be used.

Some preferred examples of acceptable non-polar waxes include glyceryl tribehenate, polyethylene, polymethylene (e.g., Accumelt 68 and 78 available from International Group, Inc., USA), $C_{18}$-$C_{36}$ triglyceride (e.g., Synchrowax HGL-C available from Croda, Inc., USA), hydrogenated high euricic aid rapeseed oil (hear stearine), ozokerite and combinations thereof. Some preferred examples of acceptable polar waxes include stearyl alcohol, hydrogenated castor oil, myristyl alcohol, cetyl alcohol, and combinations thereof. The wax may comprise a blend of polar and non-polar waxes. For example, a combination of a polar and non-polar waxes may be selected from the list above.

Antiperspirant Actives

The antiperspirant compositions may comprise a particulate antiperspirant active that is insoluble in the liquid ingredients of the antiperspirant composition. While it is desirable to include an antiperspirant active, it will be appreciated that the compositions described herein may also be suitable for deodorant compositions, wherein a deodorant active or agent is substituted for the antiperspirant actives described hereafter. Concentrations of particulate antiperspirant actives can range from about 15%, 20% or 25% to about 35% or 30% by weight of the composition, or any combination thereof. Such weight percentages can be calculated by taking the total active raw material level and multiplying it by the anhydrous assay of the active as determined by the USP method for assay determination (e.g., United States Pharmacopeia 37-National Formulary 32) as commonly known in the art. The antiperspirant active as formulated in the composition can be in a form of dispersed particulate solids. These solids may have an average particle size or equivalent diameter of about 100 microns or less, about 20 microns or less, or about 10 microns or less.

The particulate antiperspirant actives can include any compound, composition, or other particulate material having antiperspirant activity. The antiperspirant actives can include astringent metallic salts. For example, the antiperspirant actives can include inorganic and organic salts of aluminum, zirconium and zinc, as well as mixtures thereof. Antiperspirant active examples can include, but are not limited to, aluminum-containing and/or zirconium-containing salts or materials, such as aluminum halides, aluminum chlorohydrate, aluminum hydroxyhalides, zirconyl oxyhalides, zirconyl hydroxyhalides, and mixtures thereof.

Exemplary aluminum salts can include those that conform to a formula:

$$Al_2(OH)_aCl_b \cdot xH_2O$$

wherein a is from about 0 to about 5; a sum of a and b is about 6; x is from about 1 to about 8; where a, b, and x can have non-integer values. For example, aluminum chlorohydroxides referred to as "¾ basic chlorohydroxide," wherein a is about 4.5; "⅚ basic chlorohydroxide", wherein a=5; and "⅔ basic chlorohydroxide", wherein a=4 can be used. Preferred aluminum salts are referred to as "enhanced" or "improved" or "activated" aluminum chlorohydrate, and as such typically have a high concentration of Band III or Peak IV. Characterization of Band III or Peak IV is well known in the art. Processes for preparing aluminum salts are well known with some examples being disclosed in U.S. Pat. No. 3,887,692, Gilman, issued Jun. 3, 1975; U.S. Pat. No. 3,904,741, Jones et al., issued Sep. 9, 1975; U.S. Pat. No. 4,359,456, Gosling et al., issued Nov. 16, 1982; and British Patent Specification 2,048,229, Fitzgerald et al., published Dec. 10, 1980, all of which are incorporated herein by reference. Mixtures of aluminum salts are described in British Patent Specification 1,347,950, Shin et al., published Feb. 27, 1974, which description is also incorporated herein by reference.

Exemplary zirconium salts can include those which conform to a formula:

$$ZrO(OH)_{2-a}Cl_a \cdot xH_2O$$

wherein a is from about 0.5 to about 2; x is from about 1 to about 7; where a and x can both have non-integer values. Such zirconium salts are described in Belgian Patent 825,146, issued to Schmitz on Aug. 4, 1975. The antiperspirant compositions can include zirconium salt complexes that additionally contain aluminum and glycine, commonly known as "ZAG complexes". Such complexes can contain aluminum chlorohydroxide and zirconyl hydroxy chloride conforming to formulas as set forth above. Preferred include zirconium salt complexes that additionally contain aluminum and glycine are referred to as "enhanced" or "improved" or "activated" aluminum chlorohydrate, and as such typically have a high concentration of Peak IV. Characterization of Peak IV is well known in the art. Such ZAG complexes are described in U.S. Pat. No. 4,331,609, issued to Orr on May 25, 1982 and U.S. Pat. No. 4,120,948, issued to Shelton on Oct. 17, 1978.

Fragrance Delivery Materials

The antiperspirant compositions may comprise fragrance delivery materials that are provided in a particulate form which would be considered part of the total solids concentration of the antiperspirant composition. Examples of some suitable materials to form the fragrance delivery material include, but are not limited to, oligosaccharides (e.g., cyclodextrin), starches, polyethylenes, polyamides, polystyrenes, polyisoprenes, polycarbonates, polyesters, polyacrylates, vinyl polymers, silicas, gelatin, and aluminosilicates. Some examples of fragrance delivery materials are described in U.S. Patent Pub. Nos. 2010/0104611; 2010/0104613; 2010/0104612; 2011/0269658; 2011/0269657; 2011/0268802; and U.S. Pat. Nos. 5,861,144; 5,711,941; and 8,147,808.

As used herein, the term "cyclodextrin" includes any of the known cyclodextrins such as unsubstituted cyclodextrins containing from six to twelve glucose units, especially alpha-cyclodextrin, beta-cyclodextrin, gamma-cyclodextrin and/or their derivatives and/or mixtures thereof. The term "uncomplexed cyclodextrin" as used herein means that the cavities within the cyclodextrin in the composition of the present invention should remain essentially unfilled prior to application to skin in order to allow the cyclodextrin to absorb various odor molecules when the composition is applied to the skin. While it is desirable that the cyclodextrins incorporated in an antiperspirant composition contain a perfume component, it is contemplated that uncomplexed cyclodextrins may be incorporated as part of the total particulate amount in some instances.

Some cyclodextrins suitable for use in the present invention include alpha-cyclodextrin, beta-cyclodextrin, gamma-cyclodextrin, their derivatives, and mixtures thereof. More preferred are beta cyclodextrin, hydroxypropyl alpha-cyclodextrin, hydroxypropyl beta-cyclodextrin, methylated-alpha-cyclodextrin or methylated-beta-cyclodextrin, and mixtures thereof. Some cyclodextrin complexes, particle sizes, and methods of formation useful herein, are disclosed in U.S. Pat. No. 5,429,628.

B. Carriers for Certain Soft Solid Antiperspirant Compositions

The antiperspirant compositions comprise one or more carriers for suspending, carrying or transferring the antiperspirant active and fillers through hair to the skin. Suitable carries may include liquids and semi-solid materials. The most preferred carriers are emollients.

While increasing the solids concentration may be beneficial for improving the feel of a soft solid antiperspirant composition, it is not without some potential tradeoffs. For example, increasing the solids concentration may lead to increased flaking of the antiperspirant composition from the skin. It is believed this tradeoff may be reduced by including a sufficient amount of one or more non-volatile carriers, preferably non-volatile liquid(s) or emollients, and more preferably a non-volatile silicone liquid and/or mineral oil or mineral oil jelly (e.g., petrolatum) or other non-volatile emollient, in the antiperspirant composition. Other liquids and/or emollients may also be included. For example, in some instances it may be desirable to include a combination of non-volatile and volatile emollients, wherein the combination aids delivery of the antiperspirant active and the fillers, and the volatile emollient evaporates thereby enhancing the dry feel of the antiperspirant composition while the remaining non-volatile emollient aids retentions of the high solids concentration on the skin.

Suitable liquids and/or emollients can include, but are not limited to, organic, silicone-containing or fluorine-containing, volatile or non-volatile, polar or non-polar liquids and/or emollients. Total concentration of the carriers in antiperspirant compositions can typically range from about 35%, 40, 45%, or 50% to about 60% or 55%, by weight of an antiperspirant composition.

In one example, an antiperspirant composition may comprise one or more silicone liquids. The total concentration of the silicone liquids may range from about 35% to about 60% of the one or more silicone liquids, by weight of the composition. In some instances, the one or more silicone liquids have a concentration from about 35% to about 45% by weight of the composition, optionally in combination with about 1% to about 5% by weight of the composition of a mineral oil or mineral oil jelly (e.g., petrolatum). Suitable silicone liquids include volatile or non-volatile silicones.

Non-limiting examples of suitable silicone liquids for use herein can include volatile silicones described in Todd et al., "Volatile Silicone Fluids for Cosmetics", Cosmetics and Toiletries, 91:27-32 (1976). Suitable amongst these volatile silicones can include cyclic silicones having from about 3 or from about 4 to about 7 or to about 6, silicon atoms. Suitable silicon carriers can include those which can conform to a formula:

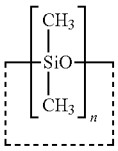

wherein n can be from about 3, from about 4 or from about 5 to about 7 or to about 6. Such volatile cyclic silicones can have a viscosity value of about 10 centistokes or less. Other suitable silicone emollients for use herein can include volatile and nonvolatile linear silicones which conform to a formula:

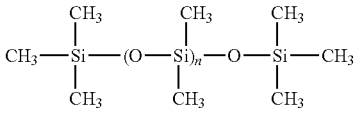

wherein n is greater than or equal to 0. Such volatile linear silicone materials can have viscosity values of about 5 centistokes or less at 25° C. Non-volatile linear silicone materials can have viscosity values of about 5 centistokes or greater at 25° C.

Suitable volatile silicones for use herein can include, but are not limited to, hexamethyldisiloxane; Silicone Fluids SF-1202 and SF-1173 (commercially available from G.E. Silicones); Dow Corning 244, Dow Corning 245, Dow Corning 246, Dow Corning 344, and Dow Coming 345, (commercially available from Dow Corning Corp.); Silicone Fluids SWS-03314, SWS-03400, F-222, F-223, F-250, and F-251 (commercially available from SWS Silicones Corp.); Volatile Silicones 7158, 7207, 7349 (available from Union Carbide); Masil SF-V™ (available from Mazer); and mixtures thereof. The volatile silicone liquids may have a concentration from about 20% to about 40% or about 25% to about 35% by weight of the antiperspirant composition.

Suitable non-volatile linear silicones for use herein can include, but are not limited to, Rhodorsil Oils 70047 available from Rhone-Poulenc; Masil SF Fluid available from Mazer, Dow Coming 200 and Dow Corning 225 (available from Dow Corning Corp.); Silicone Fluid SF-96 (available from G.E. Silicones); Velvasil™ and Viscasil™ (available from General Electric Co.); Silicone L-45, Silicone L-530, and Silicone L-531 (available from Union Carbide); and Siloxane F-221 and Silicone Fluid SWS-101 (available from SWS Silicones). The non-volatile silicone liquid may have a concentration from about 5% to about 20%, or about 5% to about 15% or about 5% to about 10% by weight of the antiperspirant composition.

Other suitable non-volatile silicone liquids for use in antiperspirant soft solid compositions can include, but are not limited to, non-volatile silicone liquids such as polyalkylarylsiloxanes, polyestersiloxanes, polyethersiloxane copolymers, polyfluorosiloxanes, polyaminosiloxanes, and combinations thereof. Such non-volatile silicone liquids can have viscosity values of less than about 100,000 centistokes, less than about 500 centistokes, or from about 1 centistokes to about 200 centistokes or to about 50 centistokes, as measured under ambient conditions. The viscosity of the silicone liquids should be selected to achieve the low and high shear rate viscosities described herein. In many instances, it is desirable for the viscosity of the silicone liquid to be between about 50 centistokes and 200 centistokes to achieve the shear rate viscosities described herein. Small amounts (e.g., less than 1% by weight of the antiperspirant composition) of high viscosity silicone gums having viscosities greater than 100,000 centistokes may also be incorporated in the antiperspirant compositions as a carrier.

Other suitable carriers for use in antiperspirant soft solid compositions can include, but are not limited to, organic emollients such as mineral oil, petrolatum, isohexadecane, isododecane, various other hydrocarbon oils, and mixtures thereof. In one embodiment, mineral oil and branched chain hydrocarbons having from about 4 or from about 6 carbon atoms to about 30 or to about 20 carbon atoms can be suitable emollients. Specific non-limiting examples of suitable branched chain hydrocarbon oils can include isoparaffins available from Exxon Chemical Company as Isopar C™ ($C_7$-$C_8$ Isoparaffin), Isopar E™ ($C_8$-$C_9$ Isoparaffin), Isopar G™ ($C_{10}$-$C_{11}$ Isoparaffin), Isopar H™ ($C_{11}$-$C_{12}$ Isoparaffin), Isopar L™ (C11-C13 Isoparaffin), Isopar M™ ($C_{13}$-$C_{14}$ Isoparaffin), and combinations thereof. Other non-limiting examples of suitable branched chain hydrocarbons can include Permethyl™ 99A (isododecane), Permethyl™ 102A (isoeicosane), Permethyl™ 101A (isohexadecane), and combinations thereof. The Permethyl™ series are available from Preperse, Inc., South Plainfield, N.J., U.S.A. Other non-limiting examples of suitable branched chain hydrocarbons can include petroleum distillates such as those available from Phillips Chemical as Soltrol™ 130, Soltrol™ 170, and those available from Shell as Shell Sol™ 70, -71, and -2033, and mixtures thereof.

Suitable organic emollients can include a Norpar™ series of paraffins available from Exxon Chemical Company as Norpar™ 12, -13, and -15; octyldodecanol; butyl stearate; diisopropyl adipate; dodecane; octane; decane; $C_1$-$C_{15}$ alkanes/cycloalkanes available from Exxon as Exxsol™ D80; $C_{12}$-$C_{15}$ alkyl benzoates available as Finsolv-TN™ from Finetex; and mixtures thereof. Other suitable emollients can include benzoate co-solvents, cinnamate esters, secondary alcohols, benzyl acetate, phenyl alkane, and combinations thereof.

C. Optional Ingredients for Certain Soft Solid Antiperspirant Compositions

In some instances, it may be desirable to include a low concentration of a hydrophilic water insoluble polar oil as a processing aid during the making process. However, these materials may also tend to interfere with active release and may negatively impact efficacy due, at least in part, to their affinity for the antiperspirant active. Thus, the amount of water insoluble hydrophilic oils may be minimized to about 5% or less, or about 3% or less, or about 2% or less by weight of the antiperspirant composition. Some water insoluble polar hydrophilic oils include hexyldecanol, PPG-14 butyl ether, octyl decanol and lauryl alcohol. Further, an antiperspirant composition may be substantially free of or free of hydrophilic water insoluble polar oils.

Antiperspirant soft solid compositions can alternatively or additionally include a deodorant active. Suitable deodorant actives can be selected from the group consisting of antimicrobial agents (e.g., bacteriocides, fungicides), malodor-absorbing material, and combinations thereof. For example, antimicrobial agents can comprise cetyl-trimethylammonium bromide, cetyl pyridinium chloride, benzethonium chloride, diisobutyl phenoxy ethoxy ethyl dimethyl benzyl ammonium chloride, sodium N-lauryl sarcosine, sodium N-palmethyl sarcosine, lauroyl sarcosine, N-myristoyl glycine, potassium N-lauryl sarcosine, trimethyl ammonium chloride, sodium aluminum chlorohydroxy lactate, triethyl citrate, tricetylmethyl ammonium chloride, 2,4,4'-trichloro-2'-hydroxy diphenyl ether (triclosan), 3,4,4'-trichlorocarbanilide (triclocarban), diaminoalkyl amides such as L-lysine hexadecyl amide, heavy metal salts of citrate, salicylate, and piroctose, for example, zinc salts, and acids thereof, heavy metal salts of pyrithione, especially zinc pyrithione, zinc phenolsulfate, farnesol, and combinations thereof. Some of these deodorant actives can be solids. When they are in the solid form, then they are counted as part of the total solids.

III. Measurement Methods

Tack Test Method

To determine a tack value for a soft solid type antiperspirant composition, the composition may be analyzed using a texture analyzer, such as Model TA XT plus Texture Analyzer available from Texture Technologies Corp., MA, USA, and having a 30 kg load cell with a 22 mm aluminum probe, a force sensitivity of 1 g, speed range of 0.01 to 40 mm/sec and speed accuracy of better than 0.1%. A fixture for mounting the antiperspirant composition in the load cell may be prepared as follows. First, form a 0.5 inch diameter hole in a piece of acetate sheet (3 inches W×2 inches L). Next, cut a piece of leneta card (e.g., catalog no. N2A-2-Opacity, available from The Leneta Co, NJ, USA) to approximately 3 inches W×2 inches L and place the piece of acetate sheet with 0.5 inch diameter hole over the leneta card. Next, apply the antiperspirant composition directly from the package and spread the composition across the 0.5 diameter hole of the acetate sheet with a spatula if it is necessary (enough to cover inside the hole and 0.5 inches outside the hole). Next, remove the actetate sheet and cut the leneta card down to 2 inches W×1 inch L with the molded antiperspirant composition in the center of the leneta card. Next, attach the leneta card with antiperspirant composition thereon to the base plate of the load cell using double sided adhesive tape. Attach a similarly shaped leneta card (but without the antiperspirant composition) to the probe using double sided adhesive tape. Cycle the load cell for 15 compression cycles using a test distance (i.e., distance between the probe and base plate) of approximately 10 mm. The tack value of the antiperspirant composition is the average value from the testing.

IV. Examples

The following examples of soft solid antiperspirant compositions suitable for use with the packages described herein are given solely for the purpose of illustration and are not to be construed as limitations of the invention as many antiperspirant compositions may be used with the packages described herein out departing from the spirit and the scope of the invention. These examples may be made using a variety of processes. For instance, Examples 8 and 9 may be made according to the teachings of U.S. Pat. No. 6,849,251 while examples for Examples 1 to 7 may be made according to the teachings of commonly assigned U.S. Ser. No. 14/090,175.

| Ingredient | 1 | 2 | 3 | 4 | 5 | 6 | 7 | 8 | 9 |
|---|---|---|---|---|---|---|---|---|---|
| Dimethicone 50 cst | 10.00 | 10.00 | 10.00 | 10.00 | 10.00 | 10.00 | 10.00 | | |
| Petrolatum | 3.00 | 3.00 | 3.00 | | 3.00 | 3.00 | 3.00 | | |
| Cyclopentasiloxane | 32.75 | 32.75 | 32.75 | 38.75 | 32.75 | 32.75 | 37.75 | 29.4 | 27.4 |
| Hear Stearine | 1.20 | 1.20 | 1.20 | 2.00 | 1.20 | 1.20 | 1.20 | | |
| Syncrowax HGL-C | 0.30 | 0.30 | 0.30 | 0.50 | 0.30 | 0.30 | 0.30 | | 3 |
| Stearyl Alcohol | 1.00 | 1.00 | 1.00 | | 1.00 | 1.00 | 1.00 | | |
| Lauryl Alcohol | 1.00 | 1.00 | 1.00 | | 1.00 | 1.00 | 1.00 | | |
| Beta Cyclodextrin | 3.00 | 3.00 | 3.00 | 3.00 | 3.00 | 3.00 | 3.00 | | |
| Tapioca Pure | 22.00 | 19.00 | 33.00 | | | | 22.00 | | |
| Dry Flo TS | | | | 18.50 | | | | | |
| Aluminum Chlorohydrate | | 28.00 | 14.00 | | | 28.00 | 20.00 | 20 | 20 |
| Aluminum Zirconium Trichlorohydrex Glycine | 25.00 | | | 26.5 | 25.00 | | | | |
| Hexadecanol | | | | | | | | 17 | 17 |
| Hydrogenated Castor oil | | | | | | | | 3 | 3 |
| Ceteareth-30 | | | | | | | | 3 | 3 |
| Peg-20 glycerol stearate | | | | | | | | 6 | 6 |
| Modified rice starch | | | | | | | | 8 | 2 |
| Vitacel CS 20 FC | | | | | | 19 | | 2 | 2 |
| Silica | | | | | | | | 1.5 | 1.5 |
| Talc | | | | | 22.00 | | | 10 | 10 |
| BHT | | | | | | | | 0.1 | |
| Aluminum Starch Succinate | | | | | | | | | 5 |
| Tocopherol Acetate | | | | | | | | | 0.1 |
| Fragrance | 0.75 | 0.75 | 0.75 | 0.75 | 0.75 | 0.75 | 0.75 | | |
| Total Solid | 52.5 | 52.5 | 52.5 | 50.5 | 52.5 | 52.5 | 52.5 | 47.5 | 47.5 |
| Wax level | 2.5 | 2.5 | 2.5 | 2.5 | 2.5 | 2.5 | 2.5 | 6 | 9 |
| Tack | 56 | 60.3 | 53.1 | 105.9 | 87.6 | 40.22 | 57.38 | 202.5 | 177.6 |

-continued

| Ingredient | 10 | 11 | 12 | 13 | 14 | 15 |
|---|---|---|---|---|---|---|
| Dimethicone | 5 | 5 | 10 | 10 | 10 | 10 |
| Petrolatum | 3 | 3 | 3 | 3 | 3 | 3 |
| Cyclopentasiloxane | 55.64 | 57.01 | 32.75 | 32.75 | 32.75 | 32.75 |
| PPG-14 butyl ether | 0.5 | 50 | | | | |
| Tribehenin | 4.5 | 1.7 | | | | |
| Accumelt | | 1.7 | | | | |
| Ozokerite | | 0.85 | | | | |
| Hear Stearine | | | 1.2 | 1.2 | 1.2 | 1.2 |
| Syncrowax HGL-C | 1.13 | | 0.3 | 0.3 | 0.3 | 0.3 |
| Stearyl Alcohol | | | 1 | 1 | 1 | 1 |
| Lauryl Alcohol | | | 1 | 1 | 1 | 1 |
| Beta Cyclodextrin | 3 | 3 | 3 | 3 | 3 | 3 |
| Tapioca Pure | | | 22 | | 19 | |
| Dry Flo TS | | | | | | |
| Corn starch | | | | 22 | | 33 |
| Aluminum Chlorohydrate | | | | | 28 | 14 |
| Aluminum Zirconium Trichlorohydrex Glycine | 26.49 | 26.49 | | | | |
| Fragrance | 0.75 | 0.75 | 0.75 | 0.75 | 0.75 | 0.75 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A packaged antiperspirant product, comprising:

an anhydrous solid antiperspirant composition comprising an antiperspirant active;

a package comprising a container body having an interior chamber with the anhydrous antiperspirant composition stored therein, a dome closing one end of the container body and comprising a plurality of apertures extending through the thickness of the dome, a movable elevator disposed within the container body, wherein the anhydrous antiperspirant composition is expellable through the plurality of apertures when the elevator is advanced toward the dome; and wherein the entire dome is formed from a metal or metal alloy, wherein the dome has thermal conductivity greater than about 5 W/m·K, and wherein the dome has a mass from about 0.5 grams to about 10 grams.

2. The packaged antiperspirant product according to claim 1, wherein the anhydrous antiperspirant composition further comprises one or more structurants.

3. The packaged antiperspirant product according to claim 2, wherein the one or more structurants comprises a wax.

4. The packaged antiperspirant product according to claim 2, wherein the one or more structurants have a concentration less than 10% by weight of the anhydrous antiperspirant composition.

5. The packaged antiperspirant product according to claim 1, wherein the anhydrous antiperspirant composition further comprises one or more fillers selected from the group consisting of tapioca starch, corn starch, oat starch, potato starch, wheat starch, talc, perfume delivery materials, and a combination thereof.

6. The packaged antiperspirant product according to claim 1, wherein the anhydrous antiperspirant composition is a soft solid.

7. The packaged antiperspirant product according to claim 1, wherein the anhydrous antiperspirant composition further comprises one or more silicone liquids.

8. The packaged antiperspirant product according to claim 1, wherein thermal conductivity is from about 10 W/m·K to about 50 W/m·K or from about 20 W/m·K to about 50 W/m·K.

9. The packaged antiperspirant product according to claim 1, wherein the thermal conductivity is from about 5 W/m·K to about 100 W/m·K.

10. The packaged antiperspirant product according to claim 6, wherein the composition comprises from about 40% to about 60%, by weight of the composition, of solids.

* * * * *